United States Patent [19]

Blesser et al.

[11] 4,181,820

[45] Jan. 1, 1980

[54] ELECTRIC REVERBERATION APPARATUS

[75] Inventors: Barry A. Blesser, Raymond, N.H.; Karl-Otto Bader, Lahr, Fed. Rep. of Germany

[73] Assignee: Franz Vertriebsgesellschaft mbH, Kippenheim, Fed. Rep. of Germany

[21] Appl. No.: 898,889

[22] Filed: Apr. 21, 1978

[30] Foreign Application Priority Data

Apr. 29, 1977 [DE] Fed. Rep. of Germany ..... 2719276

[51] Int. Cl.[2] ..... H04R 3/00

[52] U.S. Cl. ..... 179/1 J

[58] Field of Search ..... 179/1 J, 1 G; 84/1 ZS

[56] References Cited

U.S. PATENT DOCUMENTS 3,217,080 11/1965 Clark ..... 179/1 J 4,005,268 1/1977 Canell et al. ..... 179/1 J

FOREIGN PATENT DOCUMENTS 1456800 11/1976 United Kingdom ..... 179/1 J

OTHER PUBLICATIONS

Schroeder, M., "Natural Sounding Artificial Reverberation", JAES, vol. 10 Nr. 3, Jul. 1962.

*Primary Examiner*—Kathleen H. Claffy

*Assistant Examiner*—E. S. Kemeny

*Attorney, Agent, or Firm*—Fleit & Jacobson

[57] ABSTRACT

An electronic reverberation apparatus, for producing artificial reverberation on a purely electronic basis with a digital computer, comprises a plurality of loops having different delay times and adapted to form sound repetitions of diminishing intensity. Some of the loops have short delay times and have an all-pass characteristic. Others of the loops have long delay times. The loops are provided with tappings each of which has a particular delay time associated with it. The delay times of the tappings themselves and the sums, differences and quotients of these delay times are in a non-harmonic relationship to one another. Each tapping feeds a corresponding damping element whereby the output from each successive tapping is reduced such that the reduction in energy corresponds to an exponential function, and a delayed and repeated combination of unreverberated input signals is fed to an output from the loop circuit. For naturalness the output of each reverberation delay unit is randomly damped.

9 Claims, 4 Drawing Figures

ELECTRIC REVERBERATION APPARATUS

BACKGROUND OF THE INVENTION

1. Field of the Invention

This invention relates to an electronic reverberation apparatus with a digital computer, and more particularly to an apparatus wherein repetitions of sound of diminishing intensity are formed by means of loops having a plurality of different delay times, namely long and short delay times, the loops with a short delay time exhibiting an all-pass character while the loops which have a long delay time have tappings.

2. Description of the Prior Art

An electronic reverberation apparatus as set forth above has been proposed, but has never been constructed or even simulated. This is because it was thought non-viable: see Frequenz, Vol. 16/1962 No. 3, H. Kuttruff "Artificial Reverberation", particularly page 96.

Particularly in sound recording when making radio or disc recordings, an artificial reverberation is created in order to create a certain three-dimensional impression by the incorporation of this artificial echo. For this purpose, it is known to use electronic reverberation generators, for example a large panel of sheet steel or gold foil which can be electro-acoustically energised to produce flexion-mode oscillations. It is also known to use wire spirals or tape loops, although with such arrangements it is possible only to achieve echo-like effects by reason of the limited number of sound reflections. These known echo generators have a high sensitivity to footsteps and to sounds conducted through the air or through solids. Also, their mechanical dimensions are too great and adjustability of their specifications is unsatisfactory.

Therefore, various attempts have been made to produce reverberation equipment on a purely electronic basis. M. R. Schroeder and B. F. Logan in the Journal of the A.E.S., July 1961, Vol. 9, No. 3, in an article entitled "Colourless Artificial Reverberation" furnished a mathematical eduction in respect of all-pass filters on a purely electronic basis, taking as the premise specially coupled loops with an all-pass characteristic.

In a later article in the Journal of the A.E.S., July 1962, Vol. 10, No. 3, entitled "Natural Sounding Artificial Reverberation", M. R. Schroeder suggested a combination of loops with a long delay time and a short delay time, the latter having an all-pass characteristic. The intention of this combination was to achieve a high density of repetitions with a long reverberation time. In the article mentioned earlier, by H. Kuttruff, entitled "Artificial Reverberation" in Frequenz, Vol. 16/1962, No. 3, particularly page 96, it is suggested that the loops have additional tappings in order to achieve a continuous abatement of the reverberation. Although this article indicates that the resultant reverberation is free from all colouration and that no flutter can be ascertained even with very short pulse-like input signals, it has however been found that it is particularly in such cases that colouration and flutter, i.e. insufficient continuity, can be observed in the decay of the reverberation. During computer simulation of this set-up, a certain signal sequence of about 20 seconds' length was in each case fed in and processed and only after a certain time could the result be heard. When, using digital computers with a high rate of operation, an electronic reverberation apparatus of the type mentioned at the outset is simulated, the following disadvantages occur:

1. Repetitions of sound or repetition times of the loops with long delay time are audible since, with dissimilar signals, a predominant repetition of signal in the rhythm of the delay times can be noted.

2. Reverberation decay is disconintuous, since the differing energy content of the long loops produces a reverberation curve which abates stepwise, so that a true-to-life decay according to an exponential function (e-function) is impossible.

3. There is a colouration due to comb filters, since the delay times are made too short.

4. Pulse transmission is imperfect, since at the commencement of a reverberation process the effect of the all-pass loops has not yet commenced and the density of sound repetitions is small. 5. In the case of excitation resembling a sine wave vibration, caused for example by a flute, the signals in the loops produce disturbing beats. This effect is particularly evident with long reverberation times.

SUMMARY OF THE INVENTION

An object of the present invention is to provide an electronic reverberation apparatus for generating artificial reverberation on a purely electronic basis, wherein the aforesaid disadvantages are avoided, i.e. wherein there is adequate continuity in the decay process of the reverberation or a true-to-life abatement of the reverberation, and wherein colouration and disturbing beats are avoided and adequate density of sound repetitions is provided.

In the case of an electronic reverberation apparatus of the type mentioned at the outset, the above object is achieved, according to the invention, in that the sums, differences and quotients of the tappings are in a non-harmonic relationship to one another, the tappings have such an amplitude distribution that the energy diminution corresponds to an e-function, and a delayed and repeated combination of unreverberated input signals are fed to the output of the loop circuit.

Using a high speed digital computer, the working speed of which amounts to 100 ns or less per instruction, artificial reverberation satisfying the most demanding quality requirements in terms of constant logarithmic decay and high density of sound reflections can be achieved. Adjustability of the reverberation values is furthermore possible within wide limits. Furthermore, the reverberation apparatus is able to work on a "real time" basis. Introduction of the first sound reflection, known from the natural reverberation pattern in rooms and delayed by a time which is characteristic of the room is, in the digital range, formed by the operation of the digital computer without the otherwise conventional external delay network, its time delay being externally adjustable. Specific sound characteristics can be adjusted, which can be determined from the widely variable parameters of the pattern of reverberation time which is dependent upon frequency over the transmission range. In the case of known reverberation generators which were hitherto available on the market, this was possible only to a very slight degree or was in some cases entirely impossible. Without any considerable extra expense, it is possible to form more than one incoherent output signal to feed mono, stereo and quadrophonic systems.

For further improvement of the pulse build-up pattern and the lack of density of sound repetitions at the commencement of a reverberation process, the combination of undecayed but delayed input signals fed to the output of the loop circuit can be damped as a function of the reverberation time in the degree of energy transmission in accordance with an e-function.

Since the ear picks up a time sequence of eigentones at different frequencies as a greater density of eigentones, the excessively inadequate effective eigentone density inherent in the system can be substantially increased by a randomly controlled length variation of the delay time of the loops. In consequence, a plurality of internal signal additions takes place with an indeterminable phase, as is the case with natural reverberation. A further supression of disturbing beats is similarly achieved in this way.

Influencing of the frequency of the reverberation pattern can be achieved if the feed-back factors of the loops with a long delay time are made frequency dependent.

The digital processor used in the invention can have a working speed per instruction of 100 ns or less. Triggering of the digital processor takes place by means of an analog to digital converter with a definition of at least 10 bits. To increase the volume range, it is possible in the case of analog to digital conversion to envisage an intermittent widening of the amplitude grid of quantization, as is known from German Auslegeschrift No. 2 155 868. In this respect, a triple threshold value controlled switch-over of amplification may be involved.

Where the invention is concerned, parts of the total digitally prepared information are branched off and their level or value diminished and stored in a delay network. The parts of the information stored are called forward from the delay network after periods of time distributed as indicated by the invention and added to the input signal arriving at the relevant moment in time. The digital information which is thus formed is fed to digital to analog converters and prepared to form corresponding output signals.

DETAILS DESCRIPTION OF THE PREFERRED EMBODIMENT

Figure 1:
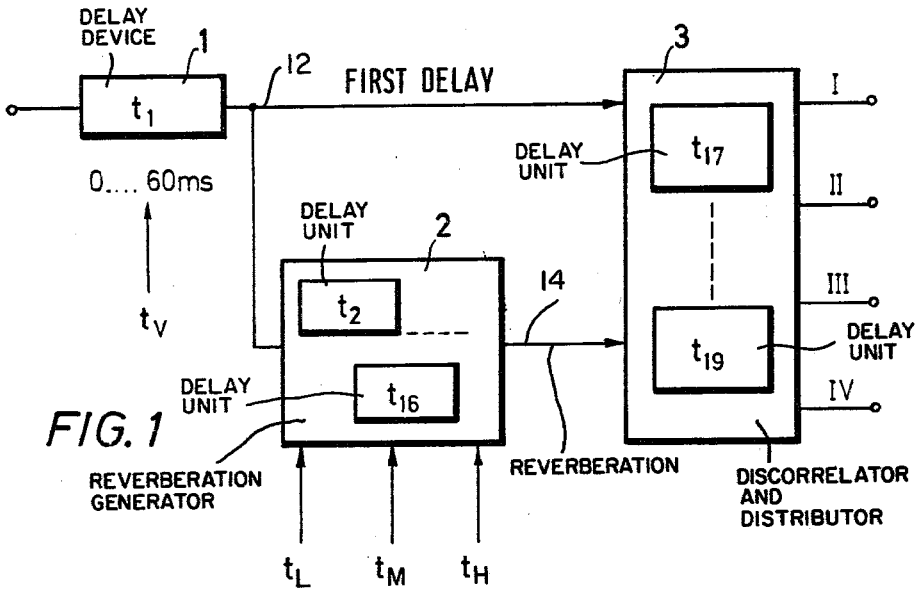
FIG. 1 is a block circuit diagram of an electronic reverberation generating apparatus.
Figure 2:
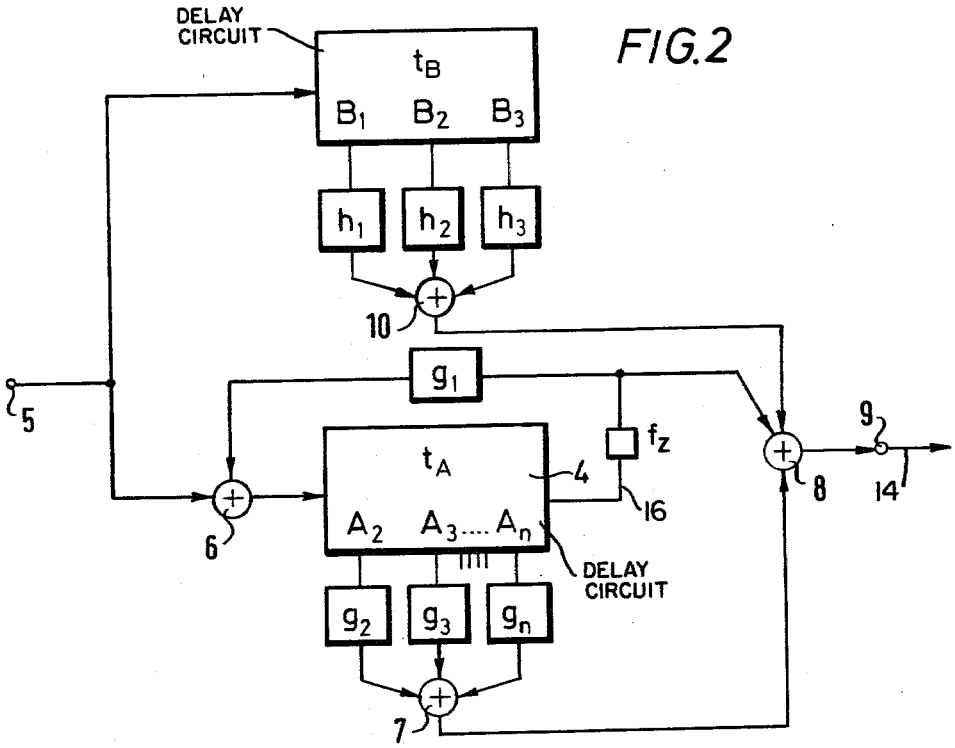
FIG. 2 is a block circuit diagram of a loop with a long delay time which represents an embodiment of the invention.

FIG. 1 is a block circuit diagram of an electronic reverberation generation apparatus. The apparatus includes a delay unit 1 of which the delay time $t_v$ is adjustable by means of a switch position (not shown) on a front panel (not shown) of the apparatus. Furthermore, the apparatus includes reverberation generating means 2 which contains various delay units or loops $t_2$–$t_{16}$ having different delay times, one of which is shown in FIG. 2. The input of the reverberation generating means 2 is connected to the output of the delay unit 1. Feedback factors are provided in the loops by damping element $g_1$ which receives the output of delay circuit 4 on line 16. The signal on line 16 is also fed to the summing circuit. Feedback factors of feedback delay times of the loops can be adjusted by corresponding switch positions (not shown) on the front panel of the apparatus. The switch positions provide suitable control signals designated as $t_L$, $t_M$ and $t_H$, which stand for low, medium and high frequency attenuation, respectively, in order to adjust the damping coefficient of damping element $g_1$. The outputs of the delay unit 1 on line 12 and of the sound generating means 2 on line 14 are connected to an output discorrelator and distributor 3 which likewise contains delay units $t_{17}$–$t_{19}$ and which has outputs I to IV. The signals on lines 12 and 14 may be combined and delayed in the discorrelator and distributor 3 in any manner, such as shown by Schroeder page 225, for distribution as a reverberated signal at each of the outputs I through IV, As mentioned above, FIG. 2 shows one of the loops $t_2$–$t_{16}$ of the sound generating means 2 of the apparatus of FIG. 1, the loop shown in FIG. 2 being a loop with a long delay time. The loop includes a delay circuit 4 or $t_4$ which has a plurality of tappings $A_2$, $A_3$ . . $A_n$ each of which has a delay time associated with it. The delay circuit 4 or $t_A$ is connected to an input 5 of the loop via a summing circuit 6. During generation of reverberation, the delay time associated with each of the tappings is such that not only the individual delay times, but also their sums, differences and relationships to one another, are in a non-harmonic relationship. A preferred way of obtaining a non-harmonic relationship is to effect the arrangement $T_n = \sqrt[n]{k}$, where n = the number of the tap and k = the total delay time. By means of corresponding damping elements $g_2$, $g_3$ . . . $g_n$ connected to the tappings $A_2$, $A_3$ . . . $A_n$, an amplitude distribution is effected such that the distribution of energy follows an e-function and not, as was initially obvious, the voltage distribution. In other words, the value associated with each of the damping elements $g_2$–$g_n$ is chosen so that the output of the summing circuit 7 has an amplitude distribution which approximates an exponential function. Further, the total delay time for the loops with a large delay time is preferably at least 300 ms.

The outputs of the damping elements $g_1$, $g_2$ . . . $g_n$ are connected to inputs of a summing circuit 7, the output of which is connected via a further summing circuit 8 to an output 9 of the loop.

An output of the delay circuit 4 or $t_A$ is connected to the output 9 of the loop, via the summing circuit 8, and is fed back to the input of the delay circuit via a damping element $g_1$ and the summing circuit 6.

Furthermore, FIG. 2 shows that the combination of an unreverberated input signal which is suitably delayed and repeated and fed to the output of the loop arrangement is damped according to an e-function, in relation to the reverberation time in the degree or extent of energy transmission. The loop shown in FIg. 2 includes a further delay unit $t_B$, having three taps $B_1$, $B_2$, $B_3$, connected in parallel with the delay circuit $t_A$. Connected to the taps $B_1$, $B_2$, $B_3$ are damping elements $h_1$, $h_2$, $h_3$ which are applied to the output 9 of the loop via a further summing circuit 10 and the above-mentioned summing circuit 8. In this way, the pulse build-up pattern and the density of sound repetitions at the commencement of a reverberation process are improved.

Figure 3:
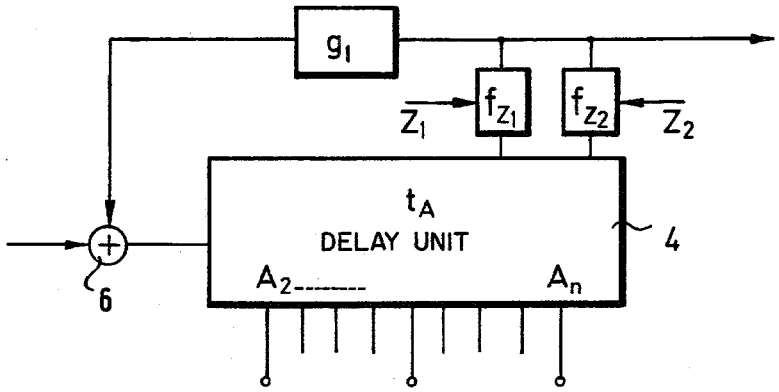
FIG. 3 is a block circuit diagram of part of a loop for the random controlled length variation of the delay times.

FIG. 3 shows in more detail a part of the loop which is shown in FIG. 2, including the delay circuit 4 or $t_A$. Outputs from the delay circuit 4 or $t_A$ are fed back to the summing circuit 6 at the input of the delay circuit through a plurality of damping elements, of which two damping elements $g_{z1}$ and $g_{z2}$ are shown. These damping elements are operated by known random noise generators or random signal generators which are not shown. Control of the damping elements by signals from the random noise generators is schematically represented by $Z_1$ and $Z_2$ for the two damping elements $f_{z1}$ and $F_{z2}$ shown. In the same way as in FIG. 2, a further damping element $g_1$ is provided in the feedback line. The outputs of the damping elements $f_z$ are furthermore connected to the summing circuit 8 at the output 9 of the loop, though this is not shown in FIG. 3. The circuit arrangement shown in FIG. 3 provides a random-controlled length variation of the delay times.

Figure 4:
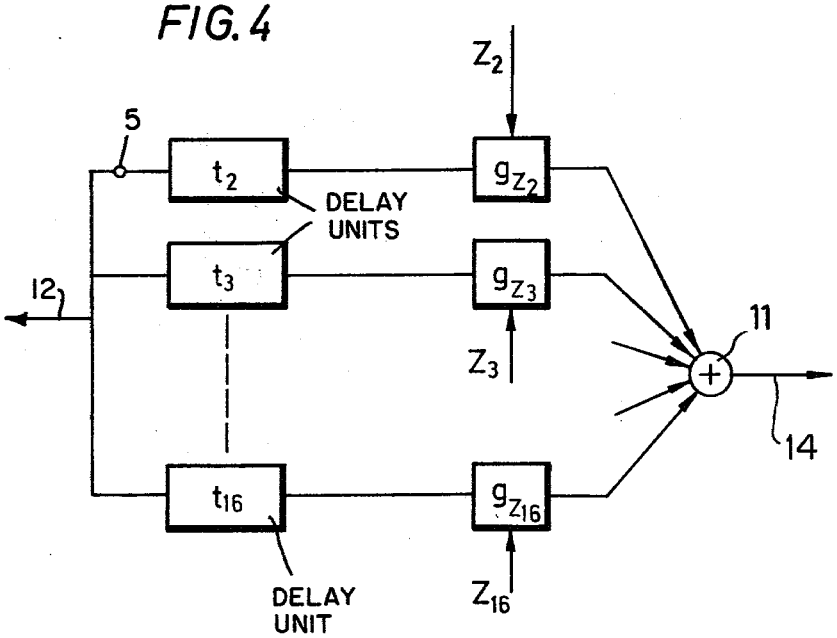
FIG. 4 is a block circuit diagram of part of a reverberation generating apparatus for random controlled mixing of loop outputs.

It can be seen from FIG. 4 that the outputs of the individual loops or delay units $t_2$ to $t_{16}$ of the sound generating means 2, of which one is shown in FIGS. 2 and 3, are connected to a summing circuit 11 via damping elements $g_{z2}$ to $g_{z16}$. These individual damping elements are controlled by signals from random noise generators (not shown). This controlling of the damping elements by signals from the random generators is schematically represented in FIG. 4 by $z_2$ to $z_{16}$. In this way, it is possible to achieve a random controlled mixing of the loop outputs.

The above disclosure was given by way of example only. Various modifications of the above disclosure are possible within the spirit and scope of the invention.

We claim:

1. Apparatus for producing artificial reverberation of a sound signal, said apparatus comprising:

a delaying device having an input for receiving said sound signal, a reverberation device connected on the output of the delaying device, for reverberating said sound signal, said reverberation device including several delaying units with different delay times, an output discorrelator and distributor that is connected to the output of the delaying device as wel as to the output of the reverberation device, each delaying unit in the reverberation device being connected to a joint input which is connected to the output of the delaying device, each delaying unit being a loop circuit that has a first delay circuit with several tappings, each tapping having a delay time associated with it so that the delay times of the tappings themselves and the sums, differences, and quotients of these delay times have a non-harmonic relationship to one another, each successive tapping feeding a corresponding damping element whereby the output from each successive tapping is reduced exponentially by its corresponding damping element and coupled to the loop output, and a second delay circuit with several tappings, said second delay circuit being connected in parallel with said first delay circuit, wherein a delayed and repeated combination of non-reverberated input signals is conveyed from said joint input to the output of the loop circuit by way of said second additional delaying circuit.

2. A reverberation apparatus according to claim 1 wherein each successive tapping in the second delay circuit feeds a corresponding damping element whereby the output from each successive tapping is reduced exponentially and coupled to the loop output.

3. A reverberation apparatus according to claim 1, further comprising means for effecting a random controlled length variation of the delay times of the loops.

4. A reverberation apparatus according to claim 1, wherein feedback factors of the loops with a long delay time are frequency dependent.

5. A reverberation apparatus according to claim 1, wherein the total delay time of the loops with a long delay time amounts to 300 ns or more.

6. A reverberation apparatus according to claim 1, comprising means for effecting random control of mixing of signals at the output of the loops.

7. A reverberation apparatus according to claim 1, wherein the time related disposition $T_n$ of the tappings satisfies the equation $T_n = \sqrt[n]{k}$ where n denotes the number of the tap and k the total delay time.

8. A reverberation apparatus according to claim 1, wherein said second delay circuit has three tappings.

9. Apparatus for producing artificial reverberation of a sound signal, said apparatus comprising:

a delaying device having an input for receiving said sound signal, a reverberation device, connected on the output of the delaying device, for reverberating said sound signal, said reverberation device including several delaying units with different delay times, an output discorrelator and distributor that is connected to the output of the delaying device as well as to the output of the reverberation device, each delaying unit in the reverberation device being connected to a joint input which is connected on the output of the delaying device, each delaying unit being a loop circuit that has a delay circuit with several tappings which are connected to the output of the loop circuit, and means for randomly mixing the outputs of said loops to produce said output of said reverberation device.

* * * * *